US005781968A

United States Patent [19]

Widmer

[11] Patent Number: 5,781,968

[45] Date of Patent: Jul. 21, 1998

[54] UNFOLDING BUCKLE CLASP

[75] Inventor: Rolf Widmer, Bienne, Switzerland

[73] Assignee: SMH Management Services AG, Biel, Switzerland

[21] Appl. No.: 893,093

[22] Filed: Jul. 15, 1997

[30] Foreign Application Priority Data

Jul. 25, 1996 [FR] France ..... 96 09385

[51] Int. Cl.[6] ..... A44C 5/00

[52] U.S. Cl. ..... 24/71 J; 24/69 J; 24/265 WS

[58] Field of Search ..... 24/71 J, 68 J, 24/69 J, 265 WS

[56] References Cited

U.S. PATENT DOCUMENTS

| | | | |
|---|---|---|---|
| 1,695,487 | 12/1928 | Hadley | 24/71 J |
| 1,756,769 | 4/1930 | Tost | 24/71 J |
| 3,550,216 | 12/1970 | Gandelman | 24/71 J |
| 3,863,299 | 2/1975 | Hocq | 24/71 J |
| 4,424,611 | 1/1984 | Mori | 24/71 J |
| 4,928,359 | 5/1990 | Gagnebin | 24/71 J |

FOREIGN PATENT DOCUMENTS

| | | |
|---|---|---|
| 2 317 892 | 11/1977 | France . |
| 685 095 | 3/1995 | Switzerland . |
| 347 968 | 5/1931 | United Kingdom . |

*Primary Examiner*—Victor N. Sakran
*Attorney, Agent, or Firm*—Griffin, Butler, Whisenhunt & Szipl

[57] ABSTRACT

The clasp wristlet is of the unfolding buckle type comprising first (4) and second (3) strips hinged to each other and comprising a catch fastening (17, 23).

At one end (25) of the second strip (3) a cover (19) is mounted so as to pivot, said cover having an opening (21) in which a projecting portion (8) of said second strip is capable of being inserted. When the clasp is in a closed position, the upper face (26) of said projecting portion (8) is situated at substantially the same level as the upper face (27) of the cover (19). In this manner the thickness of the clasp is reduced.

The clasp may advantageously be used for a watch wristlet.

8 Claims, 3 Drawing Sheets

UNFOLDING BUCKLE CLASP

The invention concerns an unfolding buckle clasp for a leather or similar type of wristlet comprising first and second strips attached to each other by one of their ends by means of a first hinge, the other end of the first strip comprising means for attaching a first strand of the wristlet and means for locking the first strip onto the second strip when the clasp is in the closed position, the other end of the second strip being mounted so as to pivot by means of a second hinge on a cover to which a second wristlet strand is attached.

A clasp corresponding to the above description is disclosed in patent document CH-A-685 095. The unfolding buckle forming the clasp of this document comprises first and second strips hinged onto each other by one of their ends and connected by their other end to first and second strands of the wristlet. In a particular embodiment, the above-mentioned patent document shows, at the end of the first strip, a buckle into which a first strand of the wristlet is inserted, and at the other end of the second strip, a cover hinged onto the latter, such cover being fitted with a bar around which the second strand is folded at a fixed length. In this embodiment, the bottom of the cover is fitted with a projection pierced to accommodate a pin onto which the second strip is hinged. Thus, in this embodiment, the second strip is situated entirely underneath the cover, thereby increasing the thickness of the clasp since said clasp is situated entirely above the second strip.

Furthermore, patent document GB 347 968 discloses an unfolding buckle clasp, in particular for a belt, as is defined by the features of the preamble of claim 1. In this clasp, the second strand of the belt is not attached to the cover but passes through a longitudinal passage provided in the cover and it is held pinched in the latter via the projecting part in the closed position of the clasp. This has the disadvantage, on the one hand, of deteriorating the end of the second strand by folding and pinching it between the cover and the projecting part, and on the other hand, of exposing the part of the upper face of the second strand extending through the opening of the cover to wear.

The present invention proposes to overcome the aforementioned drawbacks by providing an unfolding buckle clasp which includes, in addition, the features defined in the characterising part of claim 1.

Figure 1:
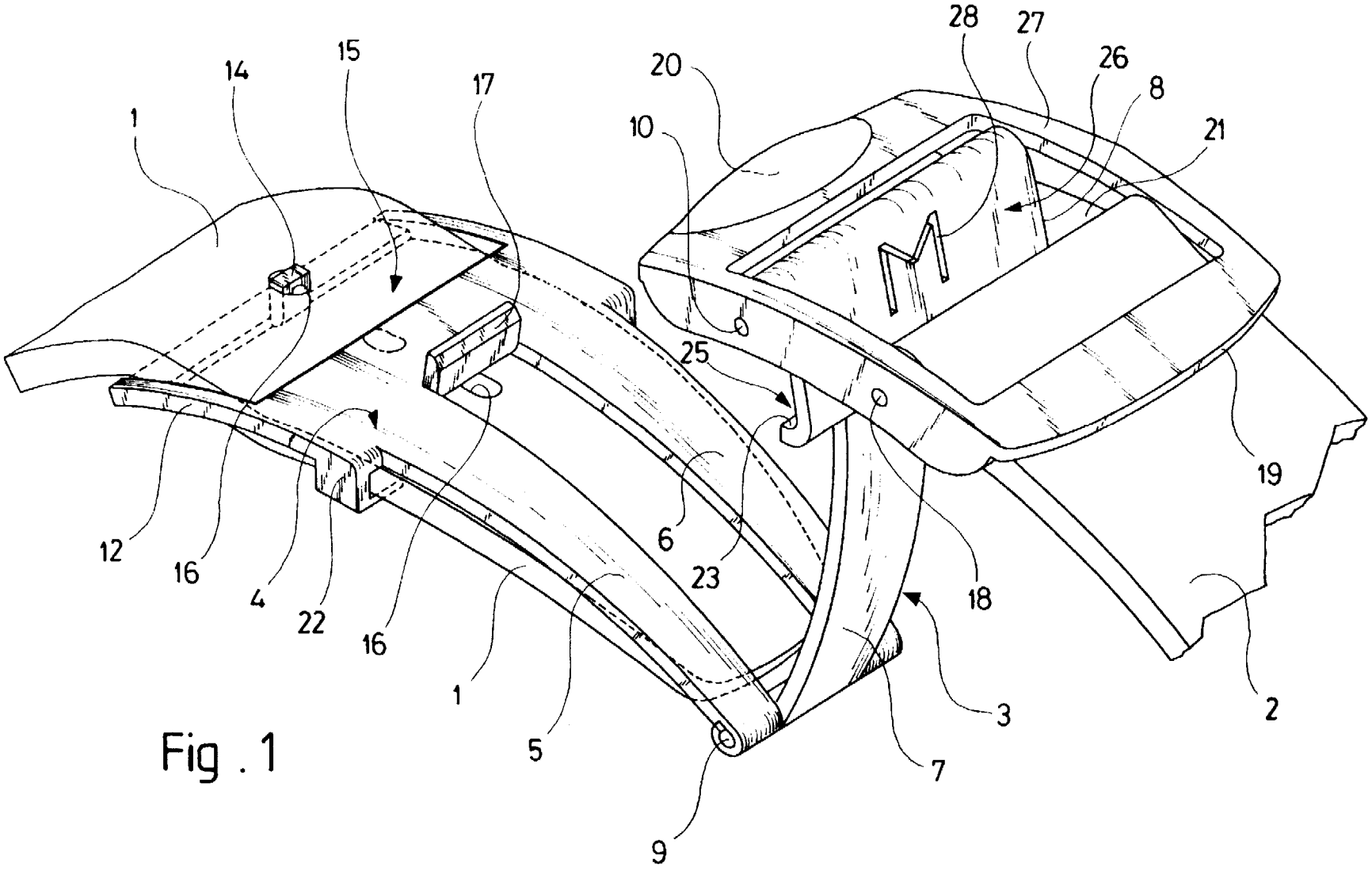
Figure 2:
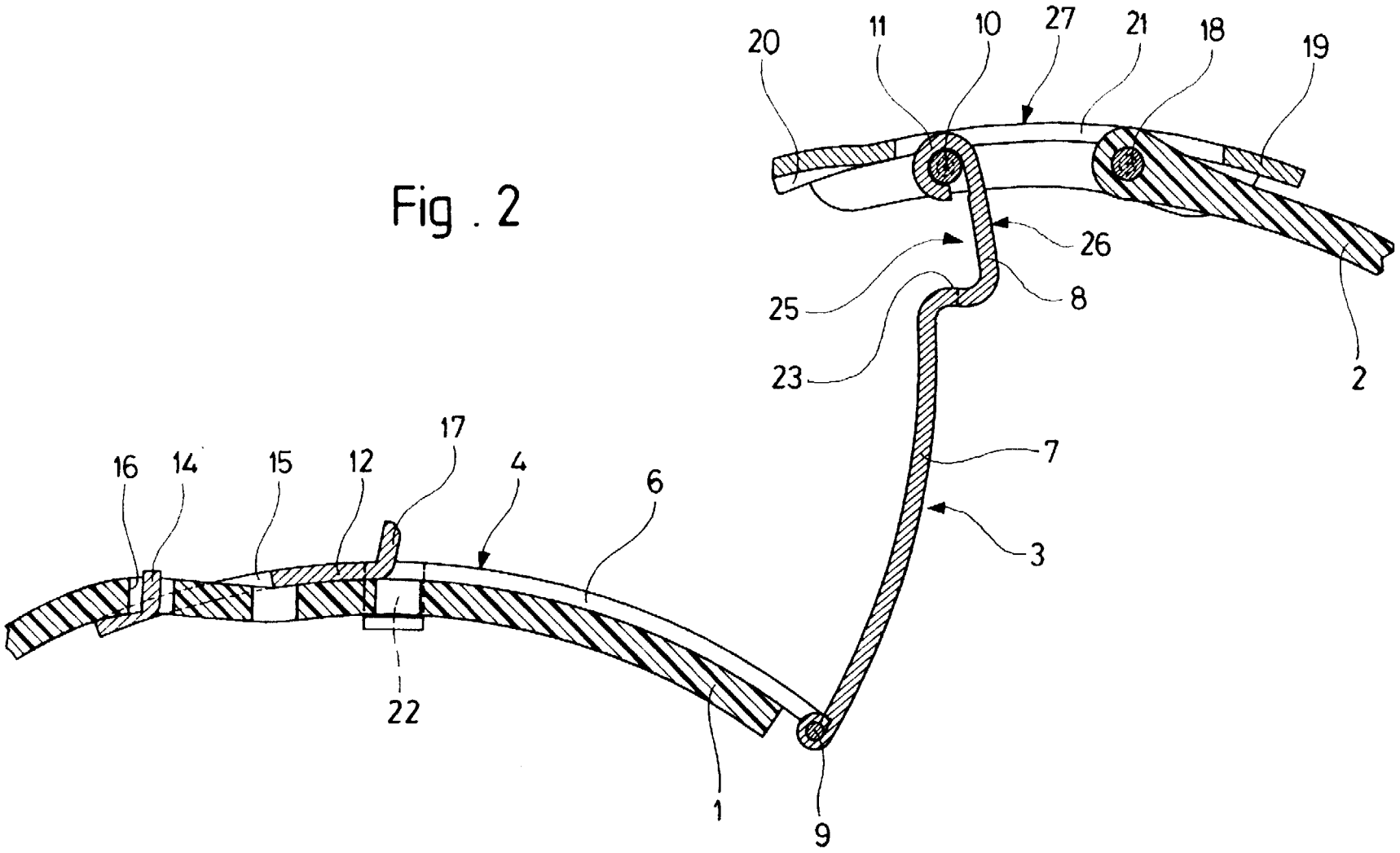
Figure 3:
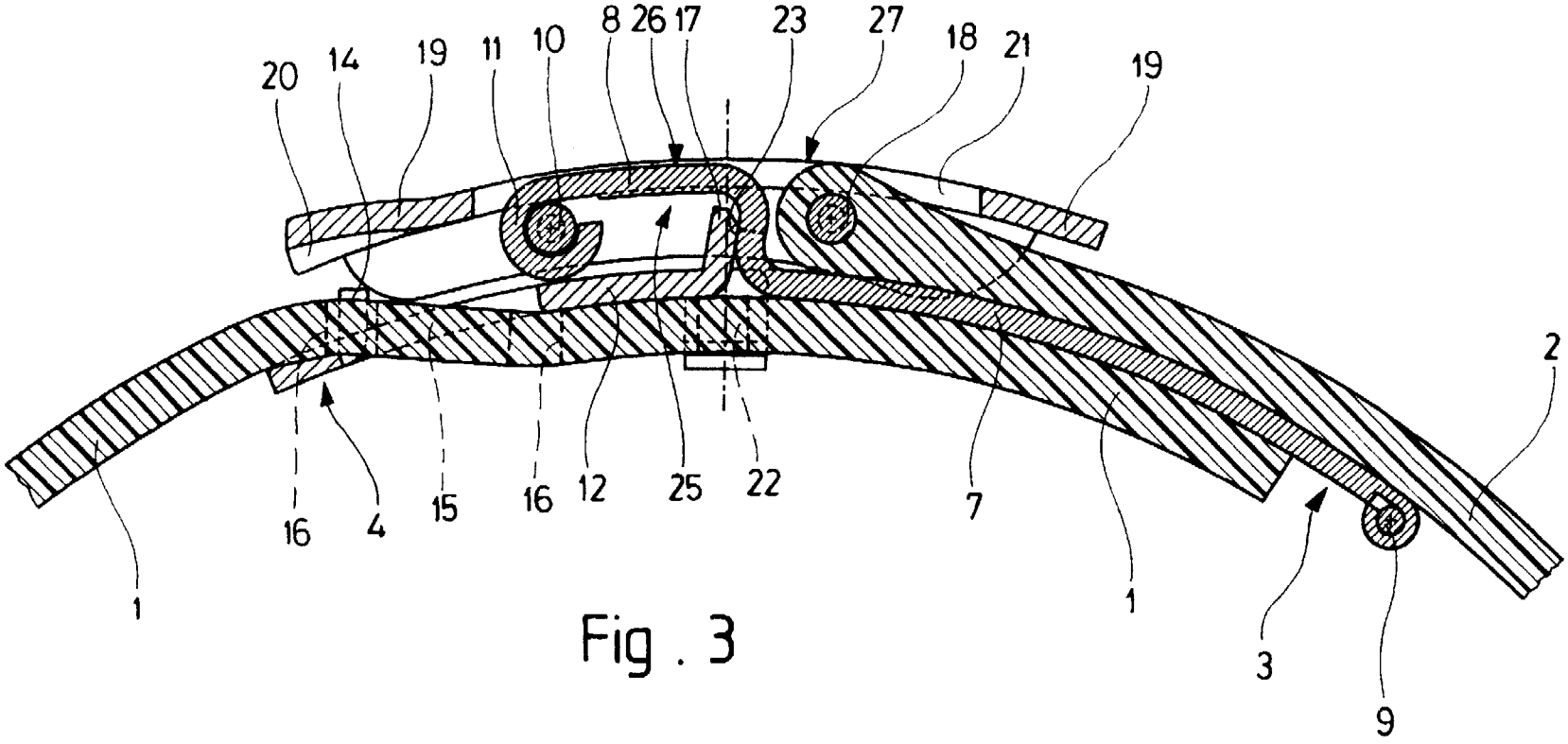

The invention will now be described in the description which follows, such description being illustrated by the drawings which show a possible embodiment example, in which:

FIG. 1 is a perspective view of the clasp of the invention, shown in the open position, FIG. 2 is a longitudinal cross-section of the clasp of FIG. 1, such clasp being shown in the open position, and FIG. 3 is a longitudinal cross-section of the clasp of FIG. 1, such clasp being shown in the closed or locked position.

The clasp of the present invention, as is clearly shown by the drawings, is of the unfolding buckle type, also called the portfolio type. As is well known, for example from the aforecited patent document CH-A-685 095, this type of clasp comprises a first strip 4 and a second strip 3. These strips are attached to each other by one of their first ends, by means of a first hinge 9. This hinge consists of a bar inserted into hinge pins provided in both strips. The other end 12 of first strip 4 comprises means for attaching a first strand 1 of the wristlet and means for locking first strip 4 onto second strip 3. The other end 25 of second strip 3 bears a cover 19 mounted so as to pivot on strip 3 by means of a second hinge 10. A second strand 2 of the wristlet is attached to this cover 19.

As is shown by FIGS. 1 to 3, the present invention is characterised in that cover 19 has an opening 21 wherein a projecting portion 8 of the other end 25 of second strip 3 is capable of being inserted. As is shown very well by FIG. 3, the upper face 26 of projecting portion 8 of second strip 3 is at substantially the same level as upper face 27 of cover 19 when the clasp is in the closed position. Thus, due to the fact that cover 19 is open, projecting portion 8 of second strip 3 may be inserted therein which reduces the total thickness of the clasp when the latter is in the closed position.

Referring now more particularly to FIG. 1, it is seen that first strip comprises two side bars 5 and 6 linked transversally and which end in hinges receiving bar 9. In the empty space between these side bars is housed a portion 7 of second strip 3 when the clasp in the closed position. Bars 5 and 6 of first strip 4 are followed by a portion 12 forming the other end of the first strip. Portion 12 has a first loop 15 into which first strand 1 of the wristlets is introduced. Strand 1, provided with perforations 16, is placed under the first strip after passing in loop 15. In order to attach first strand 1 to first strip 4, a first tongue 14 is provided in the region preceding the entry of the strand into the first loop, such tongue thus being inserted in one of perforations 16 of strand 1. It will be understood that by selecting the suitable perforation, the length of the wristlet may thus be adjusted.

The figures also show that under first strip 4 is a second loop 22 arranged after first loop 15. This second loop is not compulsory but is useful for receiving and guiding the end of first strand 1.

In the clasp shown in the example, locking of first strip 4 onto second strip 3 is achieved in the following manner. A second tongue 17 is raised from first strip 4 as is clearly seen in all the figures. As is particularly well seen in FIGS. 2 and 3, between portion 7 of second strip 3 and projecting portion 8 of the same strip a bent portion 23 is provided and which locks or latches onto second tongue 17 of first strip 4 (FIG. 3) when the clasp is in the closed position. It can thus be said that bent portion 23 fulfils two functions: it is used for locking the strips onto each other and as a junction between portions 7 and 8 of second strip 3, projecting portion 8 allowing, as has already been explained, the thickness of the clasp to be reduced.

FIGS. 2 and 3 also show that end 11 of projecting portion 8 is rolled up to form second hinge 10 attaching second strip 3 to cover 19. The same figures further show that second strand 2 is attached to cover 19 by means of a third hinge 18. This hinge is made in a known manner of a bar housed in holes made in the wings of cover 19, such bar passing through the end of second strand 2.

It will be noted here that it is not necessary for the wristlet strands to be specially prepared to fit the clasp of the invention. Indeed, the latter behaves like an ordinary buckle with a loop and tongue on the one hand for accommodating a strand, and a bar on the other hand for accommodating the other strand. Thus, for example, the clasp of the invention can replace the known conventional buckle on the Swatch watch (registered trademark) without any modification of the wristlet.

The figure also show that in order to facilitate opening of the clasp, cover 19 comprises a raised portion 20 underneath which a nail can slide.

Finally, since it is visible, upper face 26 of projecting portion 8 may comprise a mark, initials or any type of decoration which are symbolised here by an M 28.

It will be noted in conclusion that the clasp of the invention may advantageously be used on a watch wristlet, made of leather or a plastic material.

What is claimed is:

1. Unfolding buckle clasp for a wristlet made of leather or suchlike, said clasp comprising a cover and first and second strips attached to each other by one of their ends by means of a first hinge, the other end of said first strip comprising means for attaching a first strand of the wristlet so that the length of the wristlet may be adjusted and means for locking said first strip onto said second strip when the clasp is in a closed position, the other end of said second strip being mounted so as to pivot by means of a second hinge on said cover, said cover having an opening into which a projecting portion of the other end of said second strip is capable of being inserted, and said projecting portion having an upper face being substantially at the same level as an upper face of said cover when the clasp is in said closed position, wherein a second strand of the wristlet is attached to said cover by means of a third hinge.

2. Clasp according to claim 1, wherein said projecting portion extends between said second and third hinges.

3. Clasp according to claim 1, wherein said other end of said first strip has an opening forming a first loop into which said first strand is introduced, said first strand being provided with perforations, an end of said first strand being placed under said first strip, said means for attaching said first strand to said first strip comprising a first tongue arranged in a region preceding the entry of said first strand into said first loop, said first tongue being inserted into one of said perforations of said first strand.

4. Clasp according to claim 3, wherein underneath said first strip a second loop is arranged after said first loop, for receiving and guiding said end of said first strand.

5. Clasp according to claim 1 comprising, between said second strip and said projecting portion which ends it, a bent portion which locks onto a second tongue arranged on the first strip when the clasp is in said closed position.

6. Clasp according to claim 1, wherein an end of said projecting portion is rolled up to form said second hinge attaching said second strip to said cover.

7. Clasp according to claim 1, wherein said cover comprises a raised portion to facilitate opening of the clasp.

8. Clasp according to claim 1, wherein a mark or decoration is applied onto said upper face of said projecting portion of said second strip.

* * * * *